US012798831B2

(12) United States Patent
Li

(10) Patent No.: US 12,798,831 B2
(45) Date of Patent: Nov. 17, 2026

(54) STACKING SYSTEM

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 296 days.

(21) Appl. No.: 18/208,891

(22) Filed: Jun. 13, 2023

(65) Prior Publication Data

US 2024/0351743 A1 Oct. 24, 2024

Related U.S. Application Data

(63) Continuation of application No. PCT/CN2023/089570, filed on Apr. 20, 2023.

(51) Int. Cl.
*B65D 21/02* (2006.01)

(52) U.S. Cl.
CPC ..... *B65D 21/0223* (2013.01); *B65D 21/0228* (2013.01)

(58) Field of Classification Search
CPC ..... B65D 21/0223; B65D 21/0228; B65D 21/0237
See application file for complete search history.

(56) References Cited

U.S. PATENT DOCUMENTS

2011/0139777 A1* 6/2011 Sosnovsky ..... B65D 45/22 220/23.83
2017/0121056 A1* 5/2017 Wang ..... B65D 21/0228

FOREIGN PATENT DOCUMENTS

DE 202015105053 U1 10/2016
DE 102015013053 A1 4/2017

OTHER PUBLICATIONS

European search report of EP23933469.1.

* cited by examiner

*Primary Examiner* — Andrew D Perreault

(57) ABSTRACT

A stacking system is provided. The stacking system includes a first stacking member, a second stacking member, a first connecting assembly, and a second connecting assembly. The first connecting assembly is arranged on the first stacking member, and the second connecting assembly is arranged on the second stacking member. The first connecting assembly and the second connecting assembly matches with each other so that the first stacking member and the second stacking member are connected and movement of the first stacking member relative to the second stacking member is limited at least in a direction Z.

8 Claims, 9 Drawing Sheets

STACKING SYSTEM

CROSS-REFERENCE TO RELATED APPLICATIONS

This application is a continuation of international patent application No. PCT/CN2023/089570, filed on Apr. 20, 2023, and titled "STACKING SYSTEM". The contents of the above identified applications are hereby incorporated herein in their entireties by reference.

TECHNICAL FIELD

The present disclosure relates to the field of stacking technologies, and in particular, to a stacking system.

BACKGROUND

In a conventional art, when items are transported or stored, an occupied space may be reduced by stacking, which facilitates handling and transportation. However, after stacking, the items are easily separated from each other due to shaking or collision. Thus, it is difficult to maintain stability of the transportation, and a safety risk during the storage is also high.

SUMMARY

According to various embodiments of the present disclosure, a stacking system is provided.

The present disclosure provides a stacking system, including a first stacking member, a second stacking member, a first connecting assembly, and a second connecting assembly. The first connecting assembly is arranged on the first stacking member, and the second connecting assembly is arranged on the second stacking member. The first connecting assembly and the second connecting assembly fitting each other, so that the first stacking member and the second stacking member are connected and movement of the first stacking member relative to the second stacking member is limited at least in a direction Z.

In an embodiment, the first connecting assembly includes a first fitting structure and a second fitting structure arranged oppositely, and the second connecting assembly includes a third fitting structure and a fourth fitting structure arranged oppositely, the first fitting structure and the second fitting structure being located at a bottom of the first stacking member; the third fitting structure and the fourth fitting structure being located on a top of a same second stacking member or respectively located on the top of two second stacking members.

In an embodiment, the stacking system has a locked state, and in the locked state, one of the first fitting structure and the second fitting structure is capable of fitting the third fitting structure, and the other is capable of fitting the fourth fitting structure.

In an embodiment, the first fitting structure includes a movable member and an elastic member, the movable member being movably disposed on the first stacking member, and the elastic member being disposed on the first stacking member and elastically acting on the movable member.

In an embodiment, when the first stacking member is stacked to the second stacking member and is pressed by an external force, the movable member is movable on the first stacking member, so that, when the first stacking member is stacked in place, the movable member is capable of returning under an elastic action of the elastic member and fitting the third fitting structure or the fourth fitting structure to define the locked state.

In an embodiment, one side of the movable member relatively away from a top of the first stacking member is provided with a first bent clamping plate. The second fitting structure includes a second bent clamping plate arranged at the bottom of the first stacking member, the third fitting structure includes a first engaging groove and the fourth fitting structure includes a second engaging groove. When the second bent clamping plate engages with the fourth fitting structure or the third fitting structure, the first bent clamping plate is capable of engaging with the third fitting structure or the fourth fitting structure.

In an embodiment, both the first engaging groove of the third fitting structure includes a first notch and the second engaging groove of the fourth fitting structure includes a second notch, and a first notch of the first engaging groove of the third fitting structure and a second notch of the second engaging groove of the fourth fitting structure are oppositely arranged. When the first fitting structure and the second fitting structure engage with the third fitting structure and the fourth fitting structure, relative movements of the first stacking member and the second stacking member in directions X, Y, and Z are limited.

In an embodiment, one side of the first bent clamping plate relatively away from the top of the first stacking member has a first guiding bevel, one side of the third fitting structure relatively away from the top of the second stacking member or one side of the fourth fitting structure relatively away from the top of the second stacking member is provided with a second guiding bevel having a slope matches that of the first guiding bevel. When the first stacking member is stacked to the second stacking member, a first clamping leg of the first bent clamping plate is capable of being clamped into the first engaging groove of the third fitting structure or the second engaging groove of the fourth fitting structure under fit between the first guiding bevel and the second guiding bevel.

In an embodiment, the movable member is slidably disposed on the first stacking member.

In an embodiment, a sliding direction of the movable member is perpendicular to a side wall of the first stacking member. When the first stacking member is stacked to the second stacking member and is pressed by the external force, the movable member moves towards a center of the first stacking member.

In an embodiment, a sliding direction of the movable member is perpendicular to a side wall of the first stacking member. When the first stacking member is stacked to the second stacking member and is pressed by the external force, the movable member moves away from a center of the first stacking member.

In an embodiment, a sliding direction of the movable member is parallel to a side wall of the first stacking member. When the first stacking member is stacked to the second stacking member and is pressed by the external force, the movable member moves along the side wall of the first stacking member.

In an embodiment, the movable member is rotatably disposed on the first stacking member.

In an embodiment, the movable member includes a rotating plate and a rotating shaft, the rotating plate being rotatably disposed on the first stacking member via the rotating shaft, the rotating plate including a first movable arm and a second movable arm connected to each other. Under a force, the first movable arm and the second movable arm are capable of rotating in opposite directions with the rotating shaft as a rotation fulcrum.

In an embodiment, one side of the first movable arm abuts against the first stacking member. One side of the second movable arm abuts against the elastic member. One side of the second movable arm relatively away from the elastic member is provided with a first bent clamping plate. The second fitting structure includes a second bent clamping plate arranged at the bottom of the first stacking member, and the third fitting structure includes a first engaging groove and the fourth fitting structure includes a second engaging groove. When the second bent clamping plate engages with the fourth fitting structure or the third fitting structure, the first stacking member is pressed, and the first bent clamping plate is capable of engaging with the third fitting structure or the fourth fitting structure.

In an embodiment, the second fitting structure includes a protrusion arranged at the bottom of the first stacking member, and the fourth fitting structure includes a recess arranged on the top of the second stacking member. Movement of the first stacking member relative to the second stacking member is limited in a direction X and a direction Y via fit between the second fitting structure and the fourth fitting structure. The movement of the first stacking member relative to the second stacking member is limited in at least the direction Z via fit between the first fitting structure and the third fitting structure.

In an embodiment, the first fitting structure includes a movable member and an elastic member. The movable member is movably disposed on the first stacking member, and the elastic member is disposed on the first stacking member and elastically acting on the movable member.

In an embodiment, when the first stacking member is stacked to the second stacking member and is pressed by the external force, the movable member is movable on the first stacking member, so that, when the first stacking member is stacked in place, the movable member is capable of returning under the elastic action of the elastic member and fitting the third fitting structure to form the locked state.

In an embodiment, the stacking system further has an unlocked state. In the unlocked state, the movable member is capable of unfitting the third fitting structure or the fourth fitting structure under the external force, so that the first stacking member is capable of being detached from the second stacking member.

In an embodiment, the first fitting structure and the second fitting structure are further oppositely arranged at a bottom of the second stacking member, and the third fitting structure and the fourth fitting structure are further oppositely arranged on a top of the first stacking member.

In an embodiment, the first stacking member includes a first box and a second box, the first box and the second box being snap-fitted with each other to define a storage cavity. The first stacking member further includes a locking structure. One side of the first box is rotatably connected to one side of the second box, and the other side of the first box is locked and snap-fitted with the other side of the second box through the locking structure. When the first stacking member is stacked to the second stacking member, the locking structure is relatively located on a peripheral side of the second stacking member.

In an embodiment, a plurality of second connecting assemblies are provided on the top of the second stacking member, and a preset distance is defined between two adjacent of the plurality of second connecting assemblies. The preset distance is used to allow first boxes of two adjacent first stacking members to rotatably unfold and fold relative to second boxes.

In an embodiment, the preset distance allows the first box of the first stacking member to rotatably unfold and fold relative to the second box at an angle greater than or equal to 90°.

In an embodiment, the second stacking member is provided with a through hole to form a handle portion, the handle portion being located in a region where the preset distance is set on the second stacking member.

Details of one or more embodiments of the present disclosure are set forth in the following accompanying drawings and descriptions. Other features, objectives, and advantages of the present disclosure become obvious with reference to the specification, the accompanying drawings, and the claims.

BRIEF DESCRIPTION OF THE DRAWINGS

In order to better describe and illustrate embodiments and/or examples of those inventions disclosed herein, reference may be made to one or more accompanying drawings. Additional details or examples used to describe the accompanying drawings should not be considered as limitations on the scope of any of the disclosed inventions, the presently described embodiments and/or examples, and the presently understood best mode of these inventions.

Figure 1:
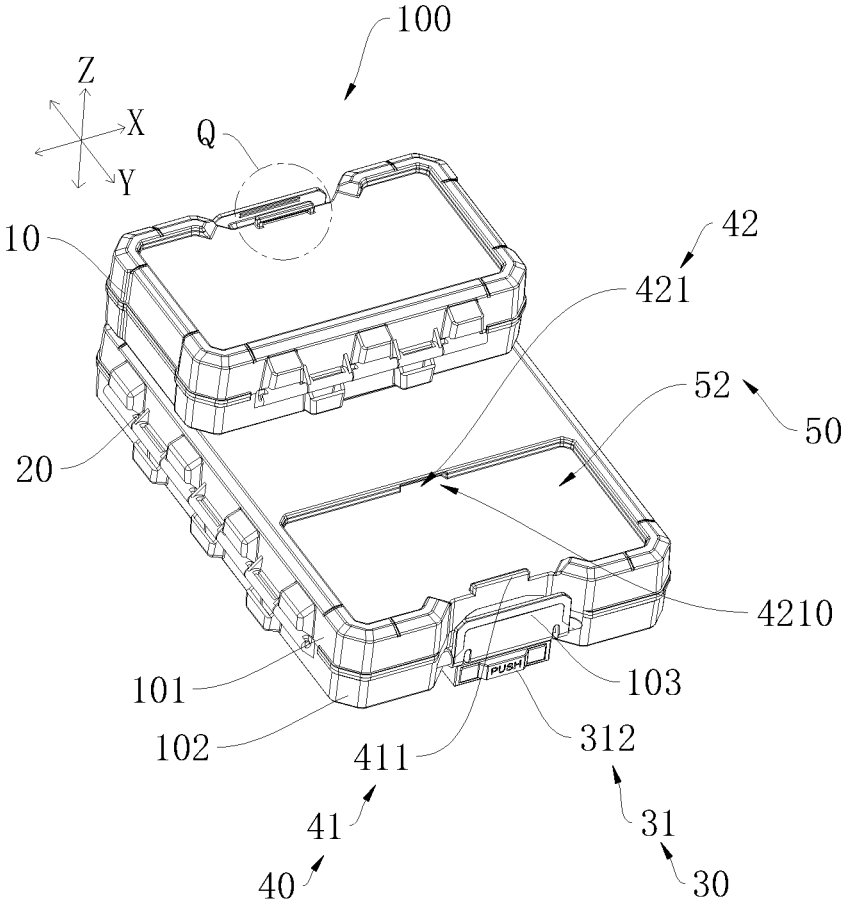
FIG. 1 is a schematic structural diagram of a stacking system according to a first embodiment of the present disclosure.
Figure 1A:
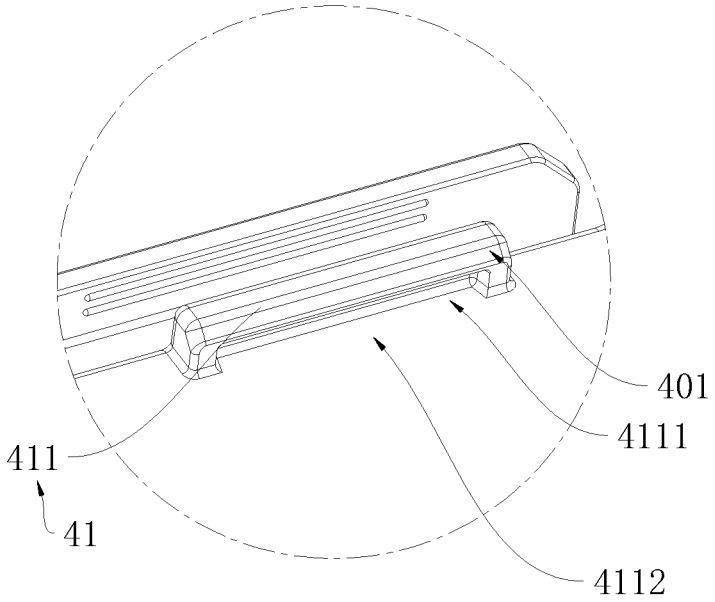
FIG. 1*a* is a schematic diagram of an enlarged structure of the stacking system at Q in FIG. 1.
Figure 2:
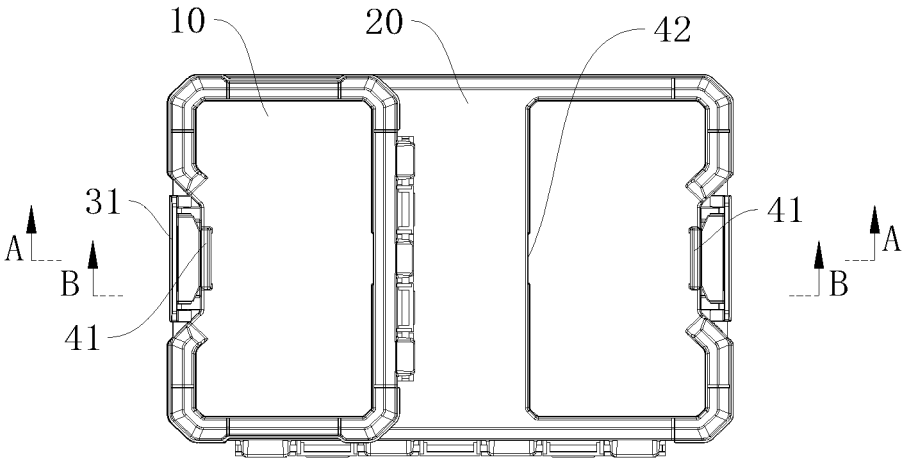
FIG. 2 is a schematic top view of the stacking system in FIG. 1.
Figure 3:
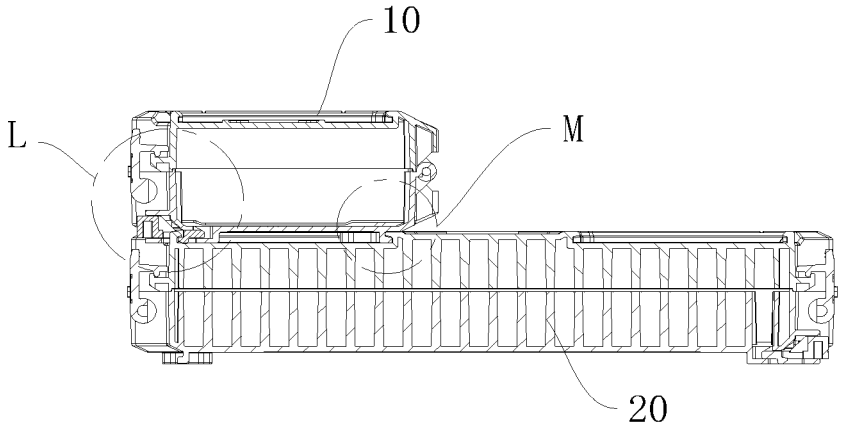
FIG. 3 is a schematic diagram of a sectional structure of the stacking system in FIG. 2 with A-A as a cut line.
Figure 4:
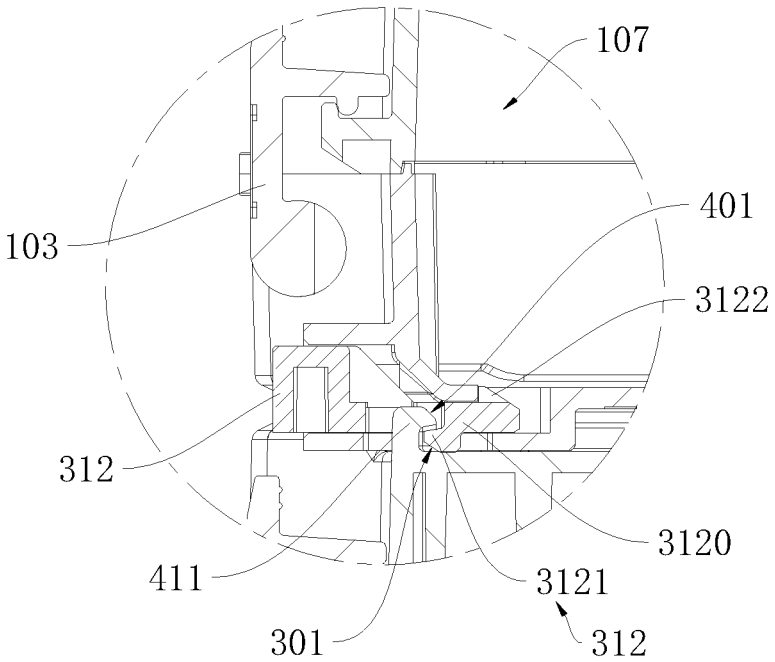
FIG. 4 is a schematic diagram of an enlarged structure of the stacking system at L in FIG. 3.
Figure 5:
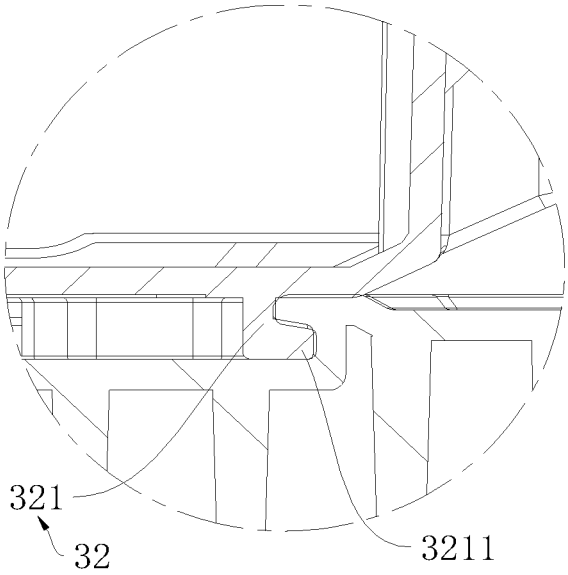
FIG. 5 is a schematic diagram of an enlarged structure of the stacking system at M in FIG. 3.
Figure 6:
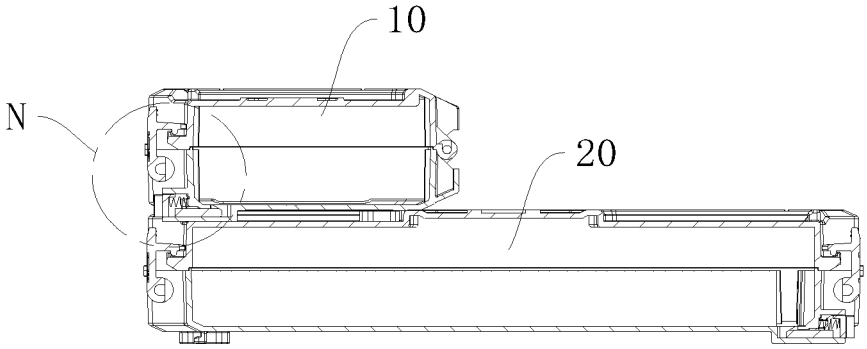
FIG. 6 is a schematic diagram of a sectional structure of the stacking system in FIG. 2 with B-B as a cut line.
Figure 7:
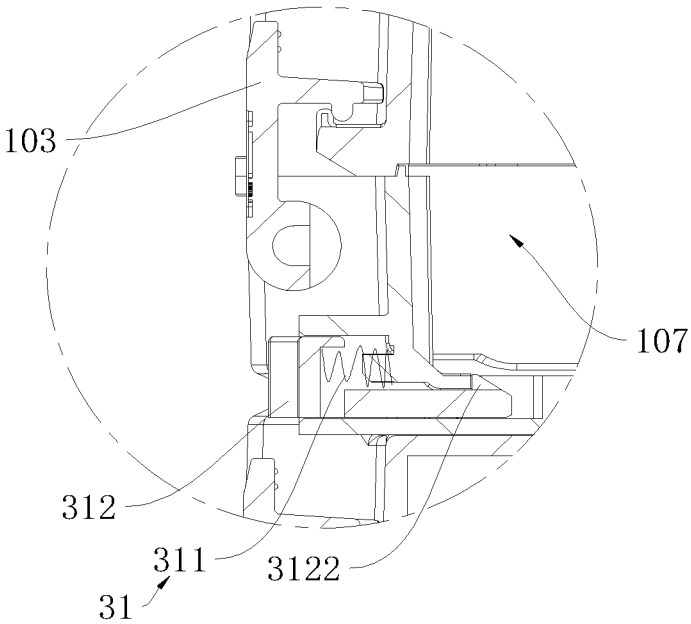
FIG. 7 is a schematic diagram of an enlarged structure of the stacking system at N in FIG. 6.
Figure 8:
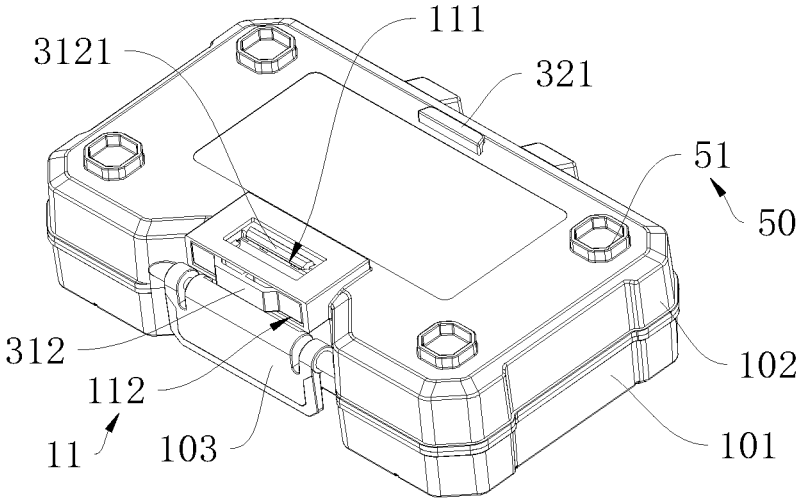
FIG. 8 is a schematic diagram of a bottom structure of a first stacking member in FIG. 1.
Figure 9:
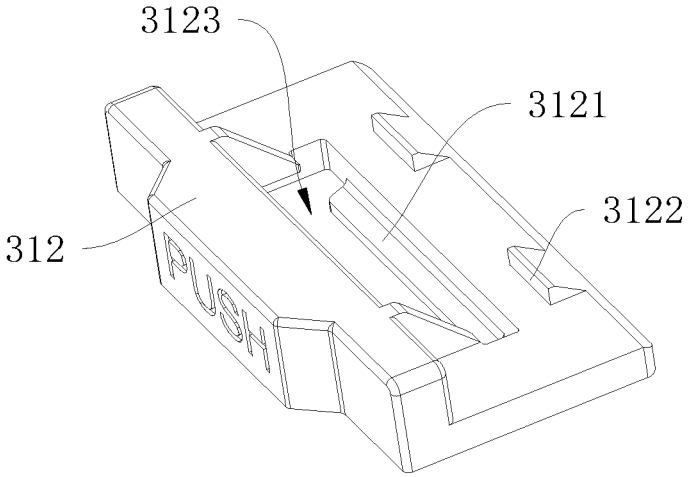
FIG. 9 is a schematic structural diagram of a movable member in FIG. 8.

In the figures, 100 represents a stacking system; 101 represents a first box; 102 represents a second box; 103 represents a locking structure; 104 represents a preset distance; 105 represents a through hole; 106 represents a handle portion; 107 represents a storage cavity; 10 represents a first stacking member; 11 represents a mounting cavity; 111 represents a third notch; 112 represents a fourth notch; 20 represents a second stacking member; 300 represents a first bent clamping plate; 301 represents a first guiding bevel; 30 represents a first connecting assembly; 31 represents a first fitting structure; 311 represents an elastic member; 312 represents a movable member; 3120 represents a first bent clamping plate; 3121 represents a first clamping leg; 3122 represents a stopper; 3123 represents a avoidance straight slot; 313 represents a rotating plate; 3131 represents a first movable arm; 3132 represents a second movable arm; 314 represents a rotating shaft; 32 represents a second fitting structure; 321 represents a second bent clamping plate; 3211 represents a second clamping leg; 322 represents a protrusion; 401 represents a second guiding bevel; 40 represents a second connecting assembly; 41 represents a third fitting structure; 411 represents a first engaging block; 4111 represents a first engaging groove; 4112 represents a first notch; 42 represents a fourth fitting structure; 421 represents a second engaging groove; 4210 represents a second notch; 422 represents a recess; 50 represents an auxiliary structure; 51 represents a limiting protrusion; and 52 represents a limiting groove.

DETAILED DESCRIPTION OF THE EMBODIMENTS

The present disclosure provides a stacking system 100. The stacking system 100 is commonly configured for storage and holding. The stacking system 100 is convenient for storage and transportation, and can avoid misalignment and separation between stacking members that are stacked on each other.

Referring to FIG. 1, FIG. 1*a*, and FIG. 2 to FIG. 9, the stacking system 100 includes a first stacking member 10, a second stacking member 20, a first connecting assembly 30, and a second connecting assembly 40. The first connecting assembly 30 is arranged on the first stacking member 10, and the second connecting assembly 40 is arranged on the second stacking member 20. The first connecting assembly 30 and the second connecting assembly 40 fit each other, so that the first stacking member 10 and the second stacking member 20 are connected and movement of the first stacking member 10 relative to the second stacking member 20 is limited at least in a direction Z.

The present disclosure has the following advantages.

According to the stacking system 100 provided in the present disclosure, the first stacking member 10 and the second stacking member 20 can maintain a stable connection at least in the direction Z via the first connecting assembly 30 and the second connecting assembly 40, which is convenient for maintaining good transportation stability after stacking and is not prone to collapse when a storage space is fully utilized, thereby effectively reducing potential safety hazards during the storage.

It may be understood that "maintain a stable connection at least in the direction Z" means that the first connecting assembly 30 and the second connecting assembly 40 fit each other so that relative displacement between the first stacking member 10 and the second stacking member 20 can be limited in the direction Z, in a direction X and the direction Z, in a direction Y and the direction Z, or in the directions X, Y, and Z.

It is to be noted that the direction Z in the present disclosure refers to an extension direction in which two stacking members are stacked on each other. In the present disclosure, the extension direction of the stacking is also a height direction of the first stacking member 10. One of the direction X and the direction Y refers to a length direction of the stacking member, and the other refers to a width direction of the stacking member. A specific situation may be set as required. For example, if the stacking member is a cylinder, the direction X and the direction Y may be optionally set.

It may be understood that upper and lower stacking positions of the first stacking member 10 and the second stacking member 20 may be selected as required, which are not limited herein. In addition, both the first stacking member 10 and the second stacking member 20 are stacking members, and the stacking system 100 may include a plurality of stacking members sequentially stacked.

It may be further understood that the first stacking member 10 and the second stacking member 20 are named relatively. For example, when three stacking members are sequentially stacked along the direction Z, the middle stacking member may be regarded as a second stacking member 20 relative to the stacking member therebelow, and may be regarded as a first stacking member 10 relative to the stacking member thereabove.

In the present disclosure, the first connecting assembly 30 includes a first fitting structure 31 and a second fitting structure 32 arranged oppositely, the second connecting assembly 40 includes a third fitting structure 41 and a fourth fitting structure 42 arranged oppositely, and the first fitting structure 31 and the second fitting structure 32 are located at the bottom of the first stacking member 10. The third fitting structure 41 and the fourth fitting structure 42 are located on a top of a same second stacking member 20 or respectively located on the top of two second stacking members 20. The stacking system 100 has a locked state, and in the locked state, one of the first fitting structure 31 and the second fitting structure 32 is capable of fitting the third fitting structure 41, and the other is capable of fitting the fourth fitting structure 42.

In order to facilitate the description of a concept and structure of the present disclosure, in an example, the first stacking member 10 is on the top, and the second stacking member 20 is at the bottom. Referring to FIG. 1 to FIG. 9 again, in a first embodiment provided in the present disclosure, the third fitting structure 41 and the fourth fitting structure 42 have a same structure and are oppositely arranged. In the locked state, the first fitting structure 31 can fit the third fitting structure 41 or the fourth fitting structure 42, and the second fitting structure 32 can fit the fourth fitting structure 42 or the third fitting structure 41.

In other words, the first fitting structure 31 and the second fitting structure 32 may correspondingly fit the third fitting structure 41 and the fourth fitting structure 42, or may correspondingly fit the fourth fitting structure 42 and the third fitting structure 41. In this way, during the stacking, a stacking direction of the first stacking member 10 can be changed freely as required, which is convenient for a user to quickly stack and connect the first stacking member 10 and the second stacking member 20, improves stacking efficiency, and avoids wasting too much time on judging whether the stacking direction is correct.

It is to be noted that, referring to a coordinate system shown in FIG. 1, in this embodiment, the direction X refers to a length direction of the first stacking member 10, the direction Y refers to a width direction of the first stacking member 10, and the direction Z refers to a height direction of the first stacking member 10.

Referring to FIG. 2 to FIG. 9 again, furthermore, in this embodiment, the stacking system 100 can be pressed by an external force to form a locked state. Specifically, the first fitting structure 31 includes a movable member 312 and an elastic member 311, the movable member 312 is movably disposed on the first stacking member 10, and the elastic member 311 is disposed on the first stacking member 10 and elastically acts on the movable member 312. When the first stacking member 10 is stacked to the second stacking member 20 and is pressed by an external force, the movable member 312 is movable on the first stacking member 10, so that, when the first stacking member 10 is stacked in place, the movable member 312 is capable of returning under an elastic action of the elastic member 311 and fitting the third fitting structure 41 or the fourth fitting structure 42 to form the locked state.

In this way, pressure can be applied to the first stacking member 10 by pressing to quickly form the locked state, and the first stacking member 10 and the second stacking member 20 are connected, which effectively reduces cumbersomeness of stacking and locking two adjacent stacking members and effectively improves operational efficiency and convenience of stacking and positioning.

Referring to FIG. 8 again, optionally, in this embodiment, one side of the movable member 312 relatively away from the top of the first stacking member 10 is provided with a first bent clamping plate 300, the second fitting structure 32 includes a second bent clamping plate 321 arranged at the bottom of the first stacking member 10, and both the third fitting structure 41 and the fourth fitting structure 42 have an engaging groove. When the second bent clamping plate 321 engages with the fourth fitting structure 42 or the third fitting structure 41, the first bent clamping plate 300 is capable of engaging with the third fitting structure 41 or the fourth fitting structure 42. It is to be noted that, for ease of understanding, in this embodiment, the engaging groove of the third fitting structure 41 may be referred to as a first engaging groove 4111, and the engaging groove of the fourth fitting structure 42 may be referred to as a second engaging groove 421.

In this way, in use, the second bent clamping plate 321 may be firstly snapped into the first engaging groove 4111 of the third fitting structure 41 or the second engaging groove 421 of the fourth fitting structure 42, and then the first stacking member 10 is pressed so that the first bent clamping plate can be snapped into the second engaging groove 421 of the fourth fitting structure 42 or the first engaging groove 4111 of the third fitting structure 41.

Referring to FIG. 3 to FIG. 7 again, in this embodiment, optionally, the third fitting structure 41 is a first engaging block 411 protruding from a top surface of the second stacking member 20, a side wall of the first engaging block 411 is provided with the first engaging groove 4111, the fourth fitting structure 42 is a second engaging block protruding from the second stacking member 20, and a side wall of the second engaging block opposite to the first engaging block 411 is provided with the second engaging groove 421. Optionally, a first notch of the first engaging groove 4111 and a second notch 4210 of the second engaging groove 421 are oppositely arranged, facing two opposite side walls of the second stacking member 20 respectively. Correspondingly, the first bent clamping plate 300 has a first clamping leg 3121, the second bent clamping plate 321 has a second clamping leg 3211, and a snapping direction of the first clamping leg 3121 is opposite to that of the second clamping leg 3211, so as to be respectively snapped into the first engaging groove 4111 and the second engaging groove 421.

It may be understood that, in other embodiments, the second fitting structure 32 may also be the same as the first fitting structure 31. That is, the second fitting structure 32 may also have the movable member 312 and the elastic member 311. In this way, the first bent clamping plate 300 of the first fitting structure 31 and the first bent clamping plate 300 of the second fitting structure 32 can engage with two engaging grooves at the same time under the pressure of the external force. It may be understood that, when this manner is adopted, a moving space is required to be reserved for the movable member 312, so as to facilitate unlocking.

Referring to FIG. 1 again, optionally, in this embodiment, both the first engaging groove 4111 of the third fitting structure 41 includes a first notch 4112, the second engaging groove 421 of the fourth fitting structure 42 includes a second notch 4210, and the first notch 4112 of the first engaging groove 4111 of the third fitting structure 41 and the second notch 4210 of the second engaging groove 421 of the fourth fitting structure 42 are oppositely arranged. When the first fitting structure 31 and the second fitting structure 32 engage with the third fitting structure 41 and the fourth fitting structure 42, relative movement of the first stacking member 10 and the second stacking member 20 in directions X, Y, and Z is limited.

It may be understood that, in this embodiment, "the relative movement in the directions X, Y, and Z is limited" means that the first stacking member 10 and the second stacking member 20 cannot displace relative to each other in left and right, front and back, up and down, and oblique directions.

In other words, in this embodiment, the engaging groove has a notch, and a plane where the notch is located is parallel to a side wall of the second stacking member 20. The first engaging groove 4111 of the third fitting structure 41 and the second engaging groove 421 of the fourth fitting structure 42 can limit movement of the first stacking member 10 in the direction Z relative to the second stacking member 20 via upper and lower side walls, limit movement of the first stacking member 10 in the direction Y relative to the second stacking member 20 via two side walls in a width direction, and limit movement of the first stacking member 10 in the direction X relative to the second stacking member 20 via a side wall of the first engaging groove 4111 in a length direction and a side wall of the second engaging groove 421 in a length direction.

It may be understood that, in other embodiments, the direction in which the first stacking member 10 may move relative to the second stacking member 20 can be selectively limited by changing the number of side walls of the engaging groove. For example, if no side walls are provided on two sides of the engaging groove along the width direction, only the movement of the first stacking member 10 relative to the second stacking member 20 in the direction X and the direction Z can be limited. Examples are not given one by one herein.

Referring to FIG. 4 again, furthermore, in this embodiment, one side of the first bent clamping plate 300 relatively away from the top of the first stacking member 10 has a first guiding bevel 301, one side of the third fitting structure 41 and/or the fourth fitting structure 42 relatively away from the top of the second stacking member 20 has a second guiding bevel 401 whose slope matches that of the first guiding bevel 301. When the first stacking member 10 is stacked to the second stacking member 20, a clamping leg of the first bent clamping plate 300 is capable of being clamped into the first engaging groove 4111 of the third fitting structure 41 or the second engaging groove 421 of the fourth fitting structure 42 under fit between the first guiding bevel 301 and the second guiding bevel 401.

In this way, the first bent clamping plate 300 and the second bent clamping plate 321 can quickly enter the corresponding engaging groove under a force.

Furthermore, the stacking system 100 further includes an unlocked state, and in the unlocked state, the movable member 312 is capable of unfitting the third fitting structure 41 or the fourth fitting structure 42 under the external force, so that the first stacking member 10 is capable of being detached from the second stacking member 20.

Referring to FIG. 1 and FIG. 8 again, the bottom of the first stacking member 10 is provided with a mounting cavity 11, and the mounting cavity 11 has a third notch 111 and a fourth notch 112. The third notch 111 faces the bottom of the first stacking member 10, and the fourth notch 112 faces a side of the first stacking member 10. The movable member 312 is movably mounted in the mounting cavity 11, and one side of the movable member 312 relatively away from the elastic member 311 faces the fourth notch 112. The third notch 111 is configured to enable the first bent clamping plate 300 to be snapped into the engaging groove, and the fourth notch 112 is configured to allow the user to apply a force to the movable member 312, so as to form the unlocked state.

It may be understood that a length of the third notch 111 and a width of the third notch 111 can allow the first bent clamping plate 300 to engage with the engaging groove, but the length of the third notch 111 and the width of the third notch 111 are smaller than an overall length of the movable member 312 and width of the movable member 312, respectively, which can restrict the movable member 312 from exiting the mounting cavity 11. A length of the fourth notch 112 and a width of the fourth notch 112 can expose part of the movable member 312, which is convenient for the user to apply a force to the movable member 312.

Optionally, in this embodiment, the movable member 312 is provided with an avoidance straight slot 3123, the first clamping leg 3121 of the first bent clamping plate 300 is located in the avoidance straight slot 3123, and the first engaging block 411 of the third fitting structure 41 can enter the avoidance straight slot 3123, so that the first clamping leg 3121 can engage with the first engaging groove 4111.

In this embodiment, the movable member 312 is slidably disposed on the first stacking member 10. The sliding connection is simple and efficient, and is easy to operate.

Furthermore, in this embodiment, a sliding direction of the movable member 312 is perpendicular to a side wall of the first stacking member 10, and when the first stacking member 10 is stacked to the second stacking member 20 and is pressed by the external force, the movable member 312 moves towards a center of the first stacking member 10. When stacked in place, the stacking member returns under the elastic action of the elastic member 311 and engages with the engaging groove.

Correspondingly, the movable member 312 can slide towards the center of the first stacking member 10 under the external force, that is, be pressed inwards to be unlocked, so that the first bent clamping plate 300 of the movable member 312 exits the engaging groove to form the unlocked state.

Specifically, when the first stacking member 10 is stacked to the second stacking member 20 and is pressed by the external force, the movable member 312 slides along the direction Y to a position close to the center of the first stacking member 10. When the stacking is in place, the movable member 312 slides along the direction Y to a position away from the center of the first stacking member 10. During the unlocking, the movable member 312 slides, under the pressure of the external force, along the direction Y to the position close to the center of the first stacking member 10, so that the first clamping leg 3121 of the first bent clamping plate 300 exits the engaging groove to separate the first stacking member 10 from the second stacking member 20. During the unlocking, a direction in which the external force is applied is parallel to the direction Y and faces the center of the first stacking member 10.

Furthermore, a stopper 3122 is also provided on one side of the movable member 312 relatively away from a bottom surface of the first stacking member 10, and the stopper 3122 is configured to limit a moving distance of the movable member 312 in a direction close to the fourth notch 112. Accuracy of fit between the first clamping leg 3121 and the engaging groove is ensured.

Referring to FIG. 1 again, furthermore, in this embodiment, the first fitting structure 31 and the second fitting structure 32 are further oppositely arranged at the bottom of the second stacking member 20, and the third fitting structure 41 and the fourth fitting structure 42 are further oppositely arranged on the top of the first stacking member 10. In other words, an additional stacking member may be stacked on the top of the first stacking member 10, and the second stacking member 20 may be stacked on other stacking members.

It is to be noted that stacking members on a same layer may all be referred to as the first stacking member 10 or the second stacking member 20. In other words, when one first stacking member 10 is stacked on the top of two second stacking members 20, the third fitting structure 41 and the fourth fitting structure 42 may be respectively located on the two second stacking members 20. In other words, the first stacking member 10 above may be fixed through the third fitting structure 41 of one second stacking member 20 and the fourth fitting structure 42 of the other second stacking member 20.

Referring to FIG. 1 to FIG. 8 again, in an embodiment of the present disclosure, the first stacking member 10 includes a first box 101 and a second box 102. The first box 101 and the second box 102 are snap-fitted with each other to form a storage cavity 107. The first stacking member 10 further includes a locking structure 103. One side of the first box 101 is rotatably connected to one side of the second box 102, and the other side of the first box 101 is locked and snap-fitted with the other side of the second box 102 through the locking structure 103. When the first stacking member 10 is stacked to the second stacking member 20, the locking structure 103 is relatively located on a peripheral side of the second stacking member 20. Optionally, the second stacking member 20 has a same structure as the first stacking member 10.

Optionally, sizes of the second stacking member 20 may be different from the sizes of the first stacking member 10. In this way, the locking structure 103 is located on the peripheral side of the stacking member, so that unfolding and folding of the first stacking member 10 and the second stacking member 20 are not affected when the first stacking member 10 and the second stacking member 20 are stacked on each other. That is, when the first stacking member 10 is stacked on the second stacking member 20, the first box 101 of the second stacking member 20 can drive the first stacking member 10 locked on the first box 101 to rotate and unfold relative to the second box 102. The first box 101 of the first stacking member 10 can also unfold and fold relative to its own second box 102.

Furthermore, in this embodiment, the second stacking member 20 is provided with two second connecting assemblies 40, and two first stacking members 10 can be stacked and locked. The two first stacking members 10 are arranged at intervals along a length direction (the direction Y) of the second stacking member 20.

It may be understood that each first stacking member 10 may be provided with a plurality of first connecting assemblies 30, and each second stacking member 20 may also be provided with a plurality of second connecting assemblies 40.

Figure 10:
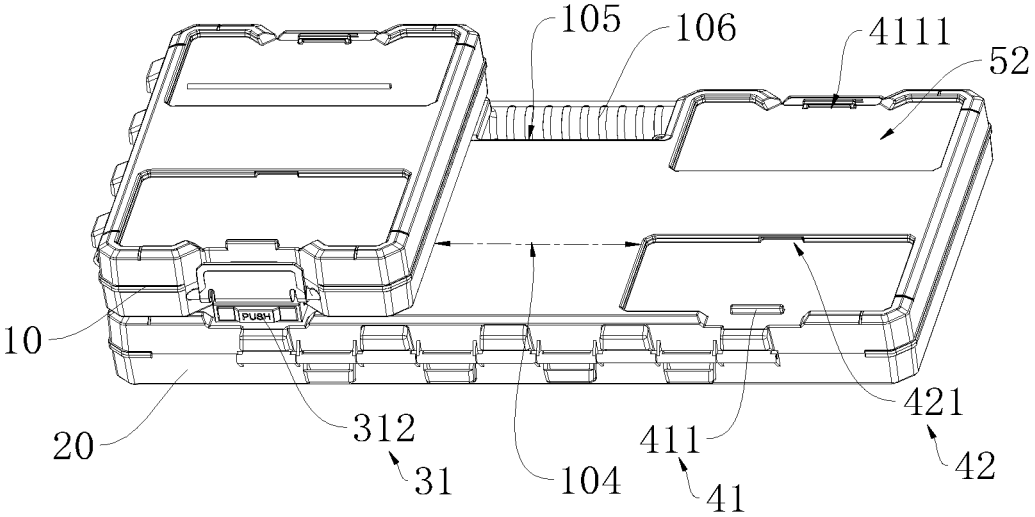
FIG. 10 is a schematic diagram of another stacking structure of a stacking system according to the present disclosure.
Figure 11:
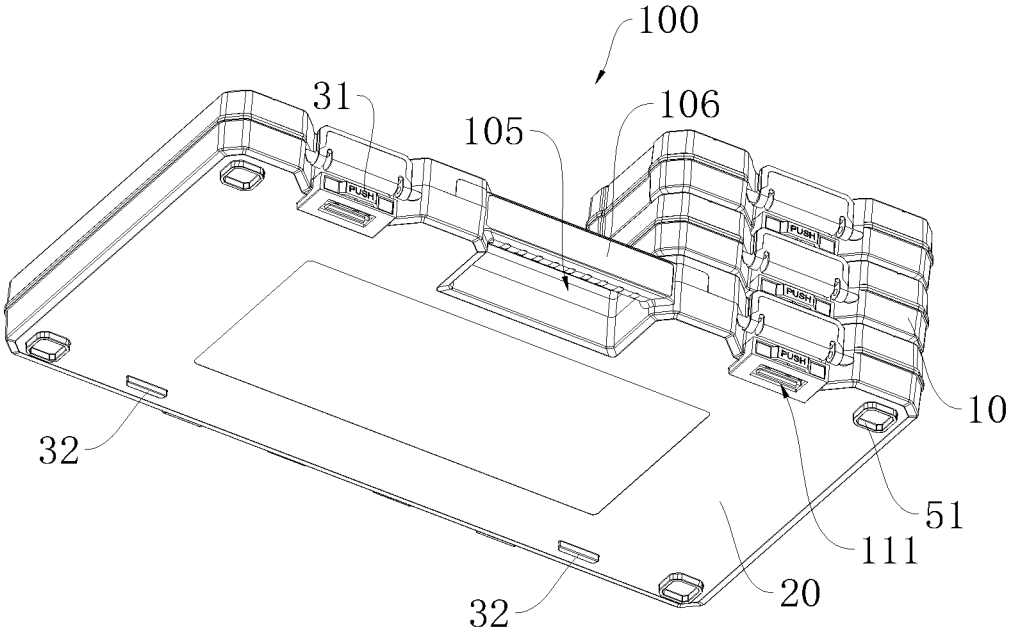
FIG. 11 is a schematic diagram of another stacking structure of a stacking system according to the present disclosure.

Referring to FIG. 1 again and referring to FIG. 10 and FIG. 11 together, in the present disclosure, a plurality of second connecting assemblies 40 may be arranged on the top of the second stacking member 20, a preset distance 104 is defined between two adjacent second connecting assemblies 40, and the preset distance 104 is used to allow first boxes 101 of two adjacent first stacking members 10 to rotatably unfold and fold relative to second boxes 102.

Optionally, the preset distance 104 allows the first box 101 of the first stacking member 10 to rotatably unfold and fold relative to the second box 102 at an angle greater than or equal to 90°. In this way, mutual interference when the two first stacking members 10 at a same floor height unfold at the same time can be prevented, which ensures that the two can unfold and fold separately or unfold and fold at the same time. It may be understood that the preset distance 104 may also cause the first box 101 of the first stacking member 10 to rotatably unfold and fold relative to the second box 102 at an angle less than 90°, provided that the first box 101 can be opened relative to the second box 102 to make it easy to take and place items from the storage cavity 107.

Furthermore, the second stacking member 20 is provided with a through hole 105 to define a handle portion 106, and the handle portion 106 is located in a region where the preset distance 104 is set on the second stacking member 20. In this way, a space can be saved, and it is convenient to pick up the whole stacking system 100 through the handle portion 106 without affecting mutual stacking of the first stacking member 10 and the second stacking member 20.

Furthermore, optionally, a thickness of the handle portion 106 is smaller than a height of the second stacking member 20, so as to ensure that when two stacking members of a same specification are stacked on each other, there is a gap between two adjacent handle portions 106, so that the user can reach in and pick up the entire stacking system 100 through one or more of the handle portions 106.

It may be understood that the first stacking member 10 and/or the second stacking member 20 include/includes, but are/is not limited to, storage bins, storage boxes, storage baskets, and the like. Shapes of the first stacking member 10 and/or the second stacking member 20 are not limited, including, but not limited to, a cuboid, a cylinder, a column, and the like. Optionally, in the present embodiment, both the first stacking member 10 and the second stacking member 20 are rectangular storage boxes. The storage box is configured to, but is not limited to, store maintenance tools.

It may be understood that, when the first stacking member 10 and the second stacking member 20 are stacked on each other, a length, a width, and a height of the upper one and a length, a width, and a height of the lower one may be set according to a requirement, provided that a plurality of stacking members can be stacked on each other.

Optionally, the length and/or the width of the lower one are/is greater than or equal to the length and/or the width of the upper one.

Optionally, in the stacking system 100, the length and the width of the lowest stacking member are no less than the length and the width of the upper stacking member.

It may be understood that the stacking system 100 may also be provided with an auxiliary structure 50 to further assist in positioning. The auxiliary structure 50 may include a first limiting member and a second limiting member, and the first limiting member and the second limiting member can fit each other to limit movement of the first stacking member 10 and the second stacking member 20 along the direction X, direction Y, direction Z, direction X and direction Y, direction X and direction Z, or direction Y and direction Z.

For example, in an embodiment, the first limiting member and the second limiting member are a limiting protrusion 51 and a limiting groove 52 respectively, one of the limiting protrusion 51 and the limiting groove 52 is located at the bottom of the first stacking member 10, and the other is located at the top of the second stacking member 20. Mutual engagement of the limiting protrusion and the limiting groove 52 can limit movement of the first stacking member 10 relative to the second stacking member 20 in the direction X and the direction Y. It may be understood that, in this way, the first engaging groove 4111 of the third fitting structure 41 and/or the second engaging groove 421 of the fourth fitting structure 42 may alternatively be provided on a side wall of the limiting groove 52. In other words, an outer wall structure for forming the engaging grooves can be flexibly arranged, provided that both the third fitting structure 41 and the fourth fitting structure 42 have an engaging groove for engaging with and limiting the first stacking member 10.

Figure 12:
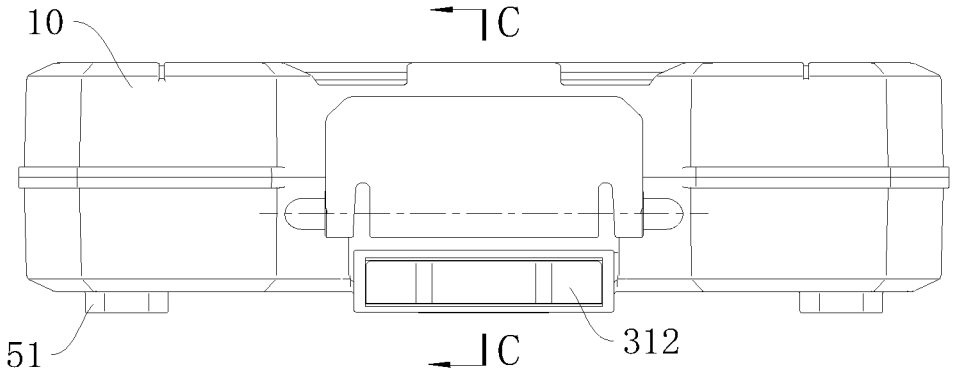
FIG. 12 is a schematic structural diagram of a first stacking member of a stacking system according to a second embodiment of the present disclosure.
Figure 13:
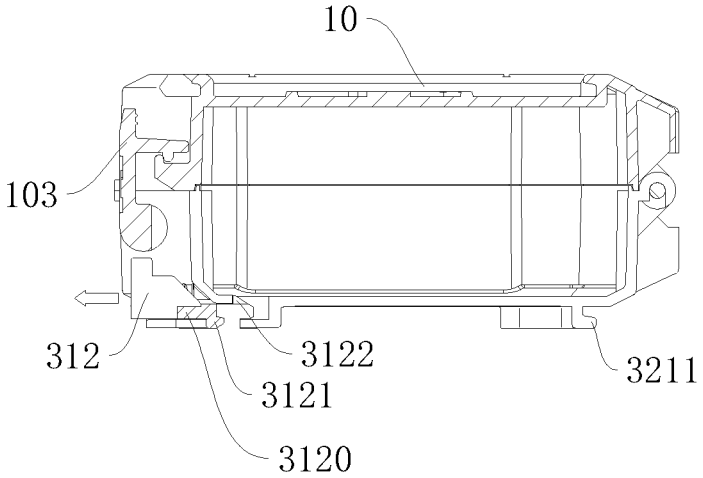
FIG. 13 is a schematic diagram of a sectional structure of the first stacking member in FIG. 12 with C-C as a cut line.

Referring to FIG. 12 and FIG. 13, the present disclosure further provides a second embodiment. A concept and most structures in the second embodiment are the same as those in the first embodiment, and differences between the second embodiment and the first embodiment are as follows.

In the second embodiment, the sliding direction of the movable member 312 is perpendicular to the side wall of the first stacking member 10. When the first stacking member 10 is stacked to the second stacking member 20 and is pressed by the external force, the movable member 312 moves away from the center of the first stacking member 10. Correspondingly, the movable member 312 can slide away from the center of the first stacking member 10 under the external force, that is, be drawn outwards to be unlocked, so that the first bent clamping plate 300 of the movable member 312 exits the engaging groove to form the unlocked state.

It is to be noted that, in this embodiment, the notch of the engaging groove faces outward, an orientation of the first notch 4112 of the first engaging groove 4111 of the third fitting structure 41 is opposite to that of the second notch 4210 of the second engaging groove 421 of the fourth fitting structure 42, and a snapping direction of the first clamping leg 3121 of the first bent clamping plate 300 is the same with that of the second clamping leg 3211 of the second bent clamping plate 321.

Specifically, when the first stacking member 10 is stacked to the second stacking member 20 and is pressed by the external force, the movable member 312 slides along the direction Y to a position away from the center of the first stacking member 10. When the stacking is in place, the movable member 312 slides along the direction Y to a position close to the center of the first stacking member 10. During the unlocking, the movable member 312 slides, under the pressure of the external force, along the direction Y to the position away from the center of the first stacking member 10, so that the first clamping leg 3121 of the first bent clamping plate 300 exits the engaging groove to separate the first stacking member 10 from the second stacking member 20. During the unlocking, a direction in which the external force is applied is parallel to the direction Y and faces one side away from the center of the first stacking member 10.

In order to facilitate the movement of the movable member 312, optionally, in this embodiment, the movable member 312 may slidably protrude from the side wall of the first stacking member 10. It may be understood that, provided that unlocking can be realized, the movable member 312 may alternatively slide to a position where it does not protrude from the side wall in other embodiments.

Furthermore, to make it easy to pull the movable member 312 to move away from the center of the first stacking member 10, the movable member 312 is provided with a pulling portion, and the pulling portion is configured to provide a force application position. The pulling portion may be a pull cord arranged on the movable member 312, or a protruding edge on the movable member 312. It may be understood that a specific structure of the pulling portion may be set as required, provided that the user can easily apply a force to pull the movable member 312 to move.

Figure 14:
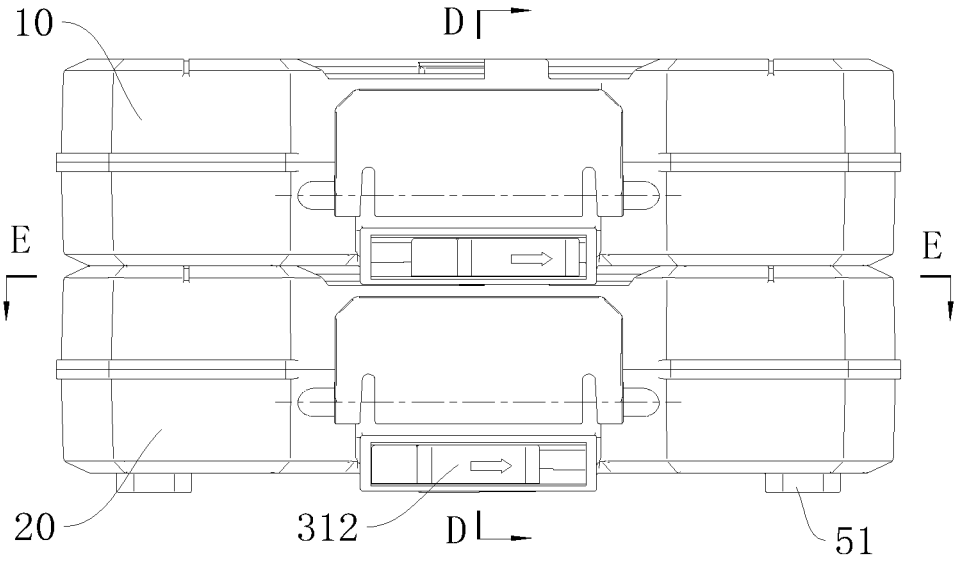
FIG. 14 is a schematic structural diagram of a stacking system according to a third embodiment of the present disclosure.
Figure 15:
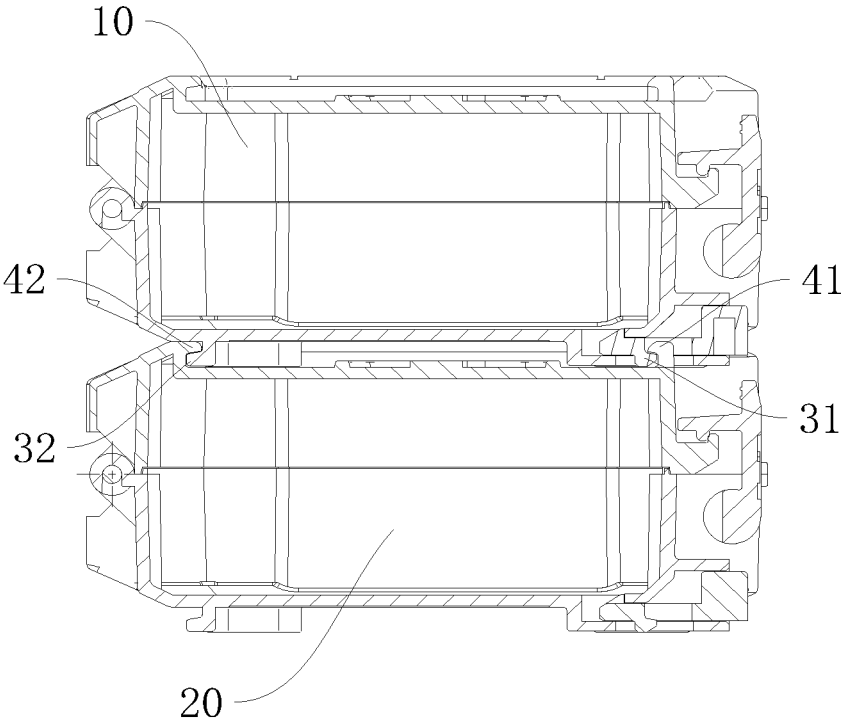
FIG. 15 is a schematic diagram of a sectional structure of the stacking system in FIG. 14 with D-D as a cut line.
Figure 16:
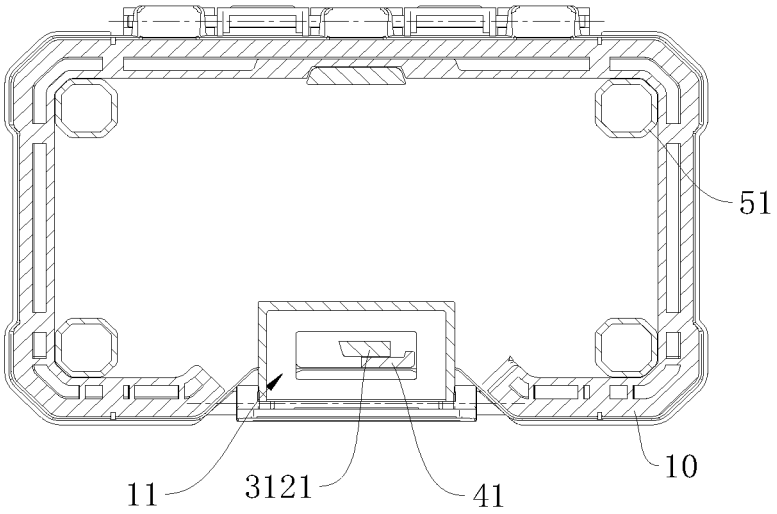
FIG. 16 is a schematic diagram of a sectional structure of the first stacking member in FIG. 14 with E-E as a cut line.

Referring to FIG. 14 to FIG. 16, the present disclosure further provides a third embodiment. A concept and most structures in the third embodiment are the same as those in the first embodiment, and differences between the third embodiment and the first embodiment are as follows.

The sliding direction of the movable member 312 is parallel to the side wall of the first stacking member 10. When the first stacking member 10 is stacked to the second stacking member 20 and is pressed by the external force, the movable member 312 moves along the side wall of the first stacking member 10. Correspondingly, the movable member 312 can slide along the direction Y under the external force, so that the first bent clamping plate 300 of the movable member 312 exits the engaging groove to define the unlocked state.

Specifically, in this embodiment, when the first stacking member 10 is stacked to the second stacking member 20 and is pressed by the external force, the movable member 312 moves along the direction Y to a position close to a side wall where the length direction of the first stacking member 10 is located. When the stacking is in place, the movable member 312 slides along the direction Y to a position away from the side wall where the length direction of the first stacking member 10 is located. During the unlocking, the movable member 312 slides, under the push of the external force, along the direction Y to the position close to the side wall where the length direction of the first stacking member 10 is located, so that the first clamping leg 3121 of the first bent clamping plate 300 exits the engaging groove to separate the first stacking member 10 from the second stacking member 20. It is to be noted that, during the unlocking, a direction in which the external force is applied is parallel to the direction Y and is perpendicular to a placement direction of the first stacking member 10.

It may be understood that, in order to facilitate the movement of the movable member 312, a length of the fourth notch 112 of the mounting cavity 11 along the direction Y is greater than or equal to twice the length of the second clamping leg 3211 of the second bent clamping plate 321 along the direction Y. The formation of the unlocked state can be ensured.

Figure 17:
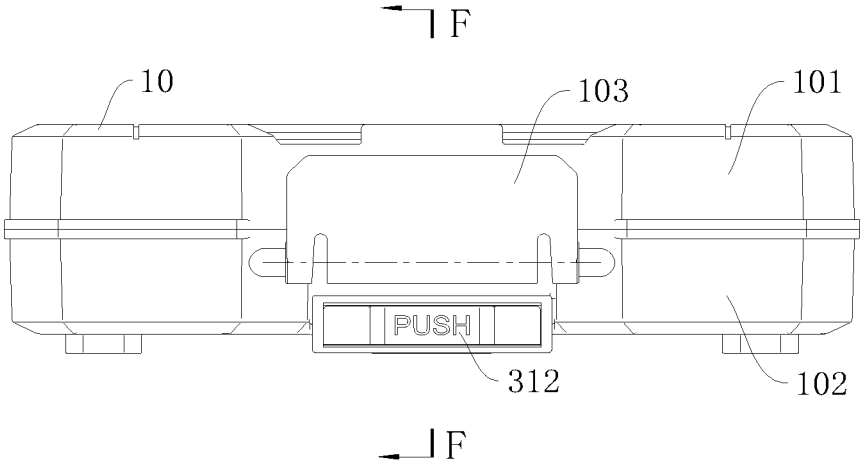
FIG. 17 is a schematic structural diagram of a first stacking member of a stacking system according to a fourth embodiment of the present disclosure.
Figure 18:
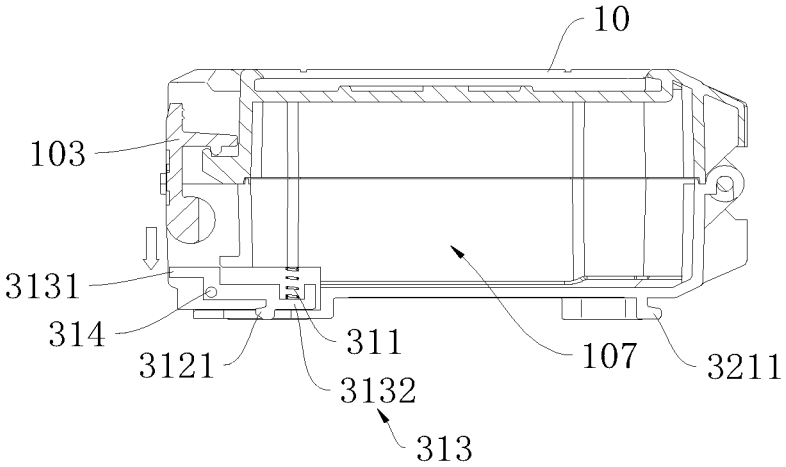
FIG. 18 is a schematic diagram of a sectional structure of the stacking system in FIG. 17 with F-F as a cut line.

Referring to FIG. 17 and FIG. 18, the present disclosure further provides a fourth embodiment. A concept and most structures in the fourth embodiment are the same as those in the first embodiment, and differences between the fourth embodiment and the first embodiment are as follows.

In the fourth embodiment, the movable member 312 is rotatably disposed on the first stacking member 10. In an embodiment of the present disclosure, the movable member 312 includes a rotating plate 313 and a rotating shaft 314, the rotating plate 313 is rotatably disposed on the first stacking member 10 via the rotating shaft 314, and the rotating plate 313 includes a first movable arm 3131 and a second movable arm 3132 connected to each other. Under a force, the first movable arm 3131 and the second movable arm 3132 are capable of rotating in opposite directions with the rotating shaft 314 as a rotation fulcrum.

One side of the first movable arm 3131 abuts against the first stacking member 10, one side of the second movable arm 3132 abuts against the elastic member 311, and one side of the second movable arm 3132 relatively away from the elastic member 311 is provided with a first bent clamping plate 300. The second fitting structure 32 includes a second bent clamping plate 321 arranged at the bottom of the first stacking member 10. Both the third fitting structure 41 and the fourth fitting structure 42 have an engaging groove. When the second bent clamping plate 321 engages with the fourth fitting structure 42 or the third fitting structure 41, the first stacking member 10 is pressed, and the first bent clamping plate 300 is capable of engaging with the third fitting structure 41 or the fourth fitting structure 42.

Correspondingly, the first movable arm 3131 of the rotating plate 313 can drive, under the external force, the second movable arm 3132 to rotate and compress the elastic member 311, that is, be pressed downwards to rotate to be unlocked, so that the first bent clamping plate 300 exits the engaging groove to form the unlocked state.

Specifically, when the first stacking member 10 is stacked to the second stacking member 20 and is pressed by the external force, the second movable arm 3132 of the rotating plate 313 rotates upwards and compresses the elastic member 311 under abutment of the third fitting structure 41 or the fourth fitting structure 42. When the stacking is in place, the movable member 312 rotates downward under the action of the elastic member 311 to reset, and engages with the engaging groove. During the unlocking, the first movable arm 3131 of the rotating plate 313 rotates downwards under the pressure of the external force, so that the second movable arm 3132 rotates upwards, the first clamping leg 3121 of the first bent clamping plate 300 exits the engaging groove, and the first stacking member 10 can be separated from the second stacking member 20.

Figure 19:
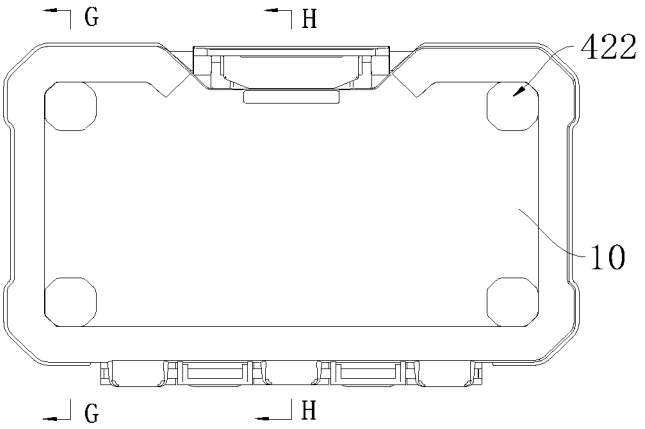
FIG. 19 is a schematic diagram of an overhead structure of a stacking system according to a fifth embodiment of the present disclosure.
Figure 20:
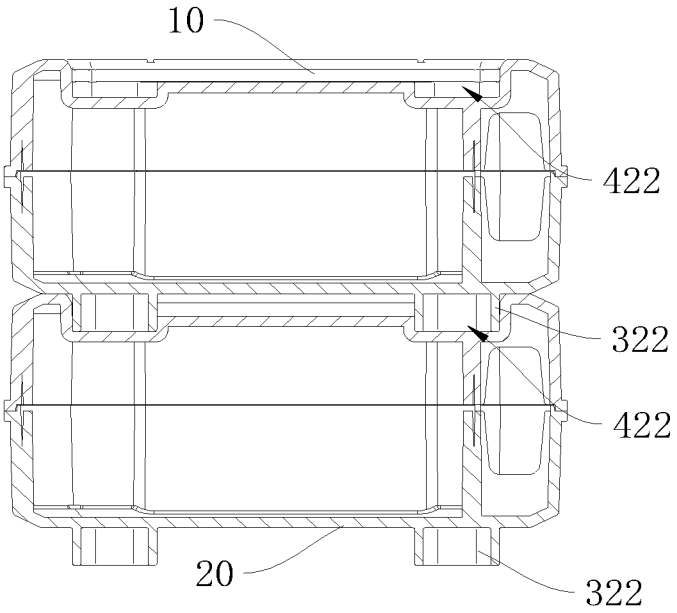
FIG. 20 is a schematic diagram of a sectional structure of the stacking system in FIG. 19 with G-G as a cut line.
Figure 21:
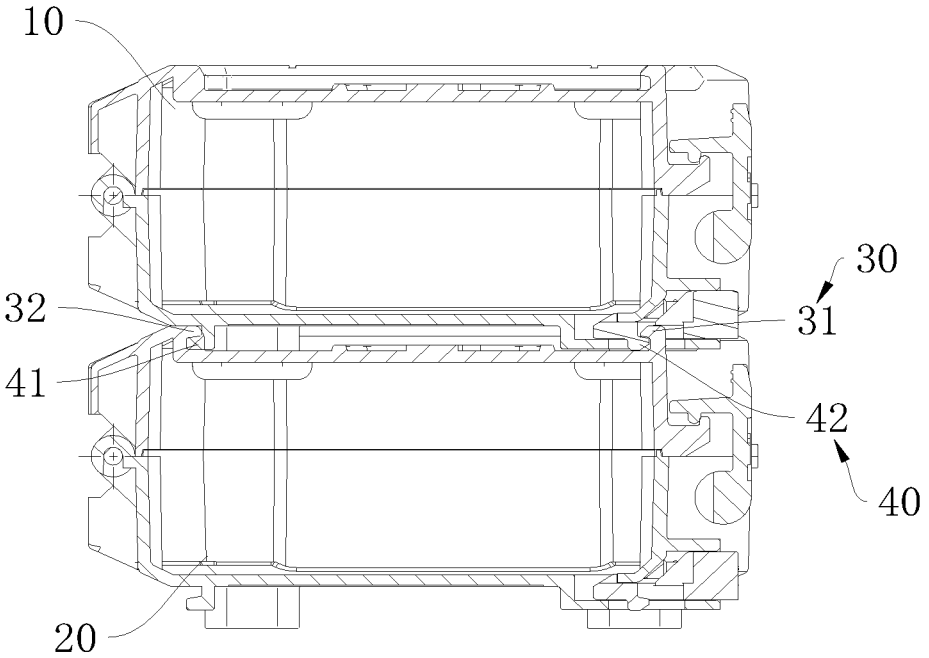
FIG. 21 is a schematic diagram of a sectional structure of a first stacking member in FIG. 19 with H-H as a cut line.

Referring to FIG. 19 to FIG. 21, the present disclosure further provides a fifth embodiment. A concept and most structures in the fifth embodiment are the same as those in the first embodiment, and differences between the fifth embodiment and the first embodiment are as follows.

In the fifth embodiment, the second fitting structure 32 includes a protrusion 322 arranged at the bottom of the first stacking member 10, and the fourth fitting structure 42 includes a recess 422 arranged on the top of the second stacking member 20. Movement of the first stacking member 10 relative to the second stacking member 20 can be limited in the direction X and the direction Y through fit between the second fitting structure and the fourth fitting structure. The movement of the first stacking member 10 relative to the second stacking member 20 can be limited in at least the direction Z through fit between the first fitting structure 31 and the third fitting structure 41.

It is to be noted that the recess 422 is a sinking groove. In other words, the recess 422 has a preset depth. In the locked state, that is, when the first fitting structure 31 fits the third fitting structure 41, the preset depth can prevent the protrusion 322 from being detached from or completely detached from the recess 422, so as to ensure that the direction Z can be effectively limited between the first fitting structure 31 and the third fitting structure 41.

Furthermore, the recess 422 has only one opening, a plane where the opening is located is parallel to the top surface of the second stacking member 20, and the opening faces up. In other words, the opening faces one side relatively away from the bottom of the second stacking member 20.

Furthermore, it may be understood that a plurality of recesses 422 and a plurality of recesses protrusions 322 may be provided, provided that numbers and positions of the plurality of recesses 422 and the plurality of recesses protrusions 322 are in one-to-one correspondence to each other.

In this embodiment, the first fitting structure 31 includes a movable member 312 and an elastic member 311, the movable member 312 is movably disposed on the first stacking member 10, and the elastic member 311 is disposed on the first stacking member 10 and elastically acts on the movable member 312. When the first stacking member 10 is stacked to the second stacking member 20 and is pressed by an external force, the movable member 312 is movable on the first stacking member 10, so that, when the first stacking member 10 is stacked in place, the movable member 312 is capable of returning under an elastic action of the elastic member 311 and fitting the third fitting structure 41 to form the locked state.

According to the stacking system 100 provided in the present disclosure, the first stacking member 10 and the second stacking member 20 can maintain a stable connection at least in the direction Z through the first connecting assembly 30 and the second connecting assembly 40, which is convenient for maintaining good transportation stability after stacking, and is not prone to collapse when a storage space is fully utilized, thereby effectively reducing potential safety hazards during the storage.

The technical features in the above embodiments may be randomly combined. For concise description, not all possible combinations of the technical features in the above embodiments are described. However, all the combinations of the technical features are to be considered as falling within the scope described in this specification provided that they do not conflict with each other.

The above embodiments only describe several implementations of the present disclosure, and their description is specific and detailed, but cannot therefore be understood as a limitation on the patent scope of the present disclosure. It should be noted that those of ordinary skill in the art may further make variations and improvements without departing from the conception of the present disclosure, and these all fall within the protection scope of the present disclosure. Therefore, the patent protection scope of the present disclosure should be subject to the appended claims.

What is claimed is:

1. A stacking system, comprising a first stacking member, a second stacking member, a first connecting assembly and a second connecting assembly, the first connecting assembly being arranged on the first stacking member, and the second connecting assembly being arranged on the second stacking member; and the first connecting assembly and the second connecting assembly fitting each other, so that the first stacking member and the second stacking member are connected and movement of the first stacking member relative to the second stacking member is limited at least in a direction Z;

wherein the first connecting assembly comprises a first fitting structure and a second fitting structure arranged oppositely, and the second connecting assembly comprises a third fitting structure and a fourth fitting structure arranged oppositely, the first fitting structure and the second fitting structure are located at a bottom of the first stacking member; the third fitting structure and the fourth fitting structure are located on a top of a same second stacking member or respectively located on the top of two second stacking members; and the stacking system has a locked state, and in the locked state, one of the first fitting structure and the second fitting structure is capable of fitting the third fitting structure, and an other of the first fitting structure and the second fitting structure is capable of fitting the fourth fitting structure;

the first fitting structure comprises a movable member and an elastic member, the movable member is movably disposed on the first stacking member, and the elastic member is disposed on the first stacking member and elastically acting on the movable member; and when the first stacking member is stacked to the second stacking member and is pressed by an external force, the movable member is movable on the first stacking member, so that when the first stacking member is stacked in place, the movable member is capable of returning under an elastic action of the elastic member and fitting the third fitting structure or the fourth fitting structure to define the locked state;

the movable member is slidably disposed on the first stacking member;

a sliding direction of the movable member is perpendicular to a side wall of the first stacking member, and when the first stacking member is stacked to the second stacking member and is pressed by the external force, the movable member moves towards a center of the first stacking member;

one side of the movable member relatively away from the top of the first stacking member is provided with a first bent clamping plate; the second fitting structure comprises a second bent clamping plate arranged at the bottom of the first stacking member; the third fitting structure is a first engaging block protruding from a top surface of the second stacking member, and a side wall of the first engaging block is provided with a first engaging groove; the fourth fitting structure is a second engaging block protruding from the second stacking member, and a side wall of the second engaging block opposite to the first engaging block is provided with a second engaging groove; a first notch of the first engaging groove and a second notch of the second engaging groove are oppositely arranged, facing two opposite side walls of the second stacking member respectively;

the first bent clamping plate has a first clamping leg, the second bent clamping plate has a second clamping leg, and a snapping direction of the first clamping leg is opposite to that of the second clamping leg; one of the first clamping leg and the second clamping leg is engaged in the first engaging groove, and an other of the first clamping leg and the second clamping leg is engaged in the second engaging groove.

2. The stacking system of claim 1, wherein both the first engaging groove of the third fitting structure comprises a first notch and the second engaging groove of the fourth fitting structure comprises a second notch, and the first notch of the first engaging groove of the third fitting structure and the second notch of the second engaging groove of the fourth fitting structure are oppositely arranged; and when the first fitting structure and the second fitting structure engage with the third fitting structure and the fourth fitting structure, relative movements of the first stacking member and the second stacking member in directions X, Y, and Z are limited.

3. The stacking system of claim 1, wherein one side of the first bent clamping plate relatively away from the top of the first stacking member has a first guiding bevel, one side of the third fitting structure relatively away from the top of the second stacking member or one side of the fourth fitting structure relatively away from the top of the second stacking member is provided with a second guiding bevel having a slope matches that of the first guiding bevel, and when the first stacking member is stacked to the second stacking member, a first clamping leg of the first bent clamping plate is capable of being clamped into the first engaging groove of the third fitting structure or the second engaging groove of the fourth fitting structure under fit between the first guiding bevel and the second guiding bevel.

4. The stacking system of claim 1, wherein the stacking system further has an unlocked state, and in the unlocked state, the movable member is capable of unfitting the third fitting structure or the fourth fitting structure under the external force, so that the first stacking member is capable of being detached from the second stacking member.

5. The stacking system of claim 1, wherein the first fitting structure and the second fitting structure are further oppositely arranged at a bottom of the second stacking member, and the third fitting structure and the fourth fitting structure are further oppositely arranged on a top of the first stacking member.

6. The stacking system of claim 1, wherein the first stacking member comprises a first box and a second box, the first box and the second box being snap-fitted with each other to define a storage cavity; the first stacking member further comprises a locking structure, one side of the first box is rotatably connected to one side of the second box, and the other side of the first box is locked and snap-fitted with the other side of the second box through the locking structure; and when the first stacking member is stacked to the second stacking member, the locking structure is relatively located on a peripheral side of the second stacking member.

7. The stacking system of claim 6, wherein a plurality of second connecting assemblies are provided on the top of the second stacking member, and a preset distance is defined between two adjacent of the plurality of second connecting assemblies, the preset distance being used to allow first boxes of two adjacent first stacking members to rotatably unfold and fold relative to second boxes.

8. The stacking system of claim 7, wherein the preset distance allows the first box of the first stacking member to rotatably unfold and fold relative to the second box at an angle greater than or equal to 90°; and/or, the second stacking member is provided with a through hole to form a handle portion, the handle portion being located in a region where the preset distance is set on the second stacking member.

* * * * *